US005575639A

United States Patent [19]

Pearl, II

[11] Patent Number: 5,575,639

[45] Date of Patent: Nov. 19, 1996

[54] COMBUSTION DEVICE ORIFICE CLEANER AND METHOD OF CLEANING

[75] Inventor: David S. Pearl, II, Fort Lauderdale, Fla.

[73] Assignee: Uniweld Products, Inc., Fort Lauderdale, Fla.

[21] Appl. No.: 220,794

[22] Filed: Mar. 31, 1994

[51] Int. Cl.[6] ..... F23D 11/38

[52] U.S. Cl. ..... 431/123; 431/120; 165/95; 15/373; 15/93.1

[58] Field of Search ..... 431/120, 123; 165/95, 94; 15/93 R, 373

[56] References Cited

U.S. PATENT DOCUMENTS

| | | | |
|---|---|---|---|
| 2,812,531 | 11/1957 | Ashley | 15/373 |
| 4,013,395 | 3/1977 | Wormser | 431/9 |
| 4,426,749 | 1/1984 | Long | 15/93 R |
| 4,732,559 | 3/1988 | Pearl, II et al. | 431/346 |
| 4,846,670 | 7/1989 | Pearl, II et al. | 431/346 |

*Primary Examiner*—Larry Jones
*Attorney, Agent, or Firm*—Nields & Lemack

[57] ABSTRACT

A fuel combuster such as a torch tip, having means therein for cleaning the orifice of the tip, as well as a method of cleaning such an orifice. The combustion device comprises a metallic elongated tube having a forward section terminating in a front end, a middle section and a rearward section, the middle section communicating at its respective ends with the forward section and the rearward section. The rearward section is adapted, suitably at its rearward end, for connection to a source of combustible gas, and is suitably provided with axially positioned fuel jet means for injecting combustible gas into the tube and with apertures for intake of combustion supporting gas to be mixed with the combustible gas. The fuel jet means includes an orifice having an elongated wire passing therethrough. Movement of the wire loosens any dirt in the orifice.

6 Claims, 3 Drawing Sheets

COMBUSTION DEVICE ORIFICE CLEANER AND METHOD OF CLEANING

BACKGROUND OF THE INVENTION

The present invention relates to a fuel combuster, more particularly to a torch tip, having an orifice cleaning element movably mounted therein.

Combustion chambers for burning premixed fuels with air have various applications, but generally require the mixing of the fuel with an oxygen source such as air, igniting the mixture, and burning the mixture. One such application is in self-contained portable torches, which use pressurized gas tanks as the fuel source. The fuel is mixed with ambient air and flows through a jet ejector or nozzle. Numerous attempts have been made to provide a torch tip which produces an even flame, which is easy to light, which will operate under any pressure, and which will not overheat. To that end, U.S. Pat. No. 4,732,559, assigned to the instant assignee and the disclosure of which is herein incorporated by reference, discloses a combustion device for generating a linear flame. The device includes means for combining a fuel gas and a combustion supporting gas, and means for stalling the combined fuel gas and combustion supporting gas when the combined gases are moving either at a low velocity or a high velocity.

Another fuel combuster is disclosed in U.S. Pat. No. 4,013,395. That device uses a vortex generator as a flame holder, which results in a swirling flame.

In gas-air tip devices such as the foregoing, clogging of the nozzle orifices is a continual problem. One method of unclogging the orifices is to reverse the flow of the orifice by using a flammable compressed gas from the cylinder to "blow out" the dirt. However, such a procedure is time-consuming and hazardous, especially in view of the use of the flammable gas.

It is therefore an object of the present invention to provide a combustion device having means for cleaning the orifice.

It is a further object of the present invention to provide a combustion device having means for cleaning the orifice that is permanently incorporated in the device.

It is a still further object of the present invention to provide a convenient and easy method of cleaning the orifice of a combustion device.

These and other objects of the present invention will become apparent upon reference to the following description, drawings and claims.

SUMMARY OF THE INVENTION

The problems of the prior art have been overcome by the present invention, which provides a fuel combuster, and more specifically, a torch tip, having means therein for cleaning the orifice of the tip, as well as a method of cleaning such an orifice.

In one embodiment of the present invention, the combustion device comprises a metallic elongated tube (e.g., a torch tip) having a forward section terminating in a front end, a middle section and a rearward section, the middle section communicating at its respective ends with the forward section and the rearward section. The rearward section is adapted, suitably at its rearward end, for connection to a source of combustible gas, and is suitably provided with axially positioned fuel jet means for injecting combustible gas into the tube and with apertures, suitably four or more in number, for intake of combustion supporting gas to be mixed with the combustible gas. The portion of the rearward section forward of the fuel jet means is provided with an axial passageway for transporting the combustible gas and the combustion supporting gas to the middle section. This passageway is of smaller diameter than the internal diameter of the forward section and the connecting middle section is at least in part of frustoconical shape, adapted to provide a Venturi effect. The fuel jet means includes an orifice having an elongated wire passing therethrough. Movement of the wire loosens any dirt in the orifice.

In an alternative embodiment, the wire passing through the orifice comprises a coiled spring portion.

DETAILED DESCRIPTION OF THE PRESENT INVENTION

It should be readily understood by those skilled in the art that the orifice cleaning device of the present invention could be used with any type of fuel combuster having an orifice, and that the following description refers specifically to the combustion device disclosed in U.S. Pat. No. 4,732,559 for purposes of illustration only, and is not to be deemed as limiting.

Figure 1:
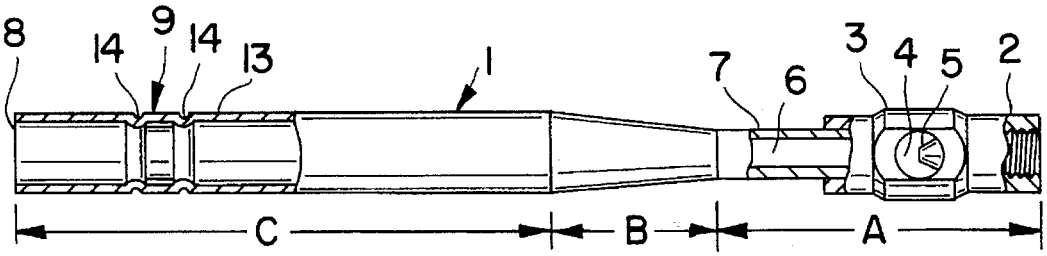
FIG. 1 is a side view of an embodiment of the torch tip of the present invention.

Turning first to FIG. 1, torch tip 1 is shown having a substantially tubular shape, and can be viewed as an elongated tube having three distinct sections A, B, C. Section A is the rearward section of torch tip 1 which is adapted at its rearward end to be connected to a source of fuel as by internally threaded means 2 or other suitable means, such as a quick connect mechanism. Section A includes a middle portion 3 of substantially rectangular cross-section which has openings 4 through which air is introduced into torch tip 1. Openings 4 are shown as four in number, each having a generally circular shape, but is should be understood that this is for illustrative purposes only; other shapes and or numbers of openings 4 may be suitable. An axially disposed jet nozzle 5 is included within the middle portion 3 of section A, and may best be seen in FIG. 4. The fuel gas passes from the source of fuel into and through jet nozzle 5, which has a centrally formed orifice 50 therein to allow for the fuel flow. The fuel gas ejected by jet nozzle 5 mixes with air which is introduced into tube 1 by openings 4. An axial passageway 6 is provided in the forward portion of the rearward section A for the passage of fuel gas and air into section B of the torch tip 1.

Connecting means 2, middle portion 3 and jet nozzle 5 are preferably made of brass. Axial passageway 6 is suitably provided by a stainless steel tube 7 which extends into and is joined to middle portion 3.

Section B is the middle section of torch tip 1 and is preferably made of stainless steel. It is formed in a generally frustoconical shape, and provides a Venturi effect causing a large quantity of air to be sucked in by the cold fuel gas ejected by jet nozzle 5 and expanded and mixed with the fuel gas prior to burning. This creates a highly efficient flame with good characteristics.

Section C is the forward, generally cylindrical section of torch tip 1 and is preferably made of stainless steel. The internal diameter of section C is larger than the diameter of passageway 6. Outlet 8 constitutes the flame end of the torch tip 1. As shown in the cutaway portion of section C, a baffle 9 can be positioned within this section to serve a gas-stalling function as explained below.

Baffle 9 includes substantially circular wire screen 10. Wire screen 10 preferably defines a curved surface, situated in section C so that the central portion of the curve is the portion of the screen closest to flame end 8 of tip 1. Wire screen 10 is further preferably made out of stainless steel woven in a plain Dutch weave pattern. Surrounding wire screen 10 is a solid metallic annular ring 11, also preferably made of stainless steel. Wire screen 10 is fastened in a groove in annular ring 11, or is made integral with annular ring 11 by any other suitable means.

Extending from annular ring 11 are a plurality of outwardly and radially extending symmetrically positioned ribs 12, preferably formed of stainless steel. Ribs 12 serve to connect the annular ring with the inside of wall 13 of torch tip 1. Ribs 12 are constrained inside torch wall 13 by friction and/or crimps 14 in the torch tip wall, or by other suitable permanent attachment methods. Spaces 15 are provided at the outside edge of annular ring 11, between ribs 12. The type of wire mesh suitable for screen 10 is that which provides sufficient resistance to greatly slow or stall passage of the gases through the screen, but allows enough gas to be extracted through for ignition. One wire screen which meets these requirements is plain Dutch weave of 50 warp×250 shute, with 0.0055" warp and 0.0045" shute, and 60 nominal micron retention.

Figure 2:
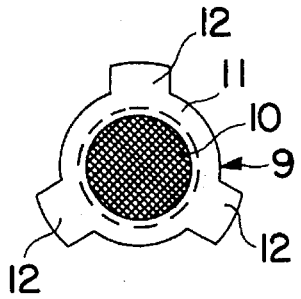
FIG. 2 is an enlarged view of the baffle forming part of the torch tip.
Figure 2A:
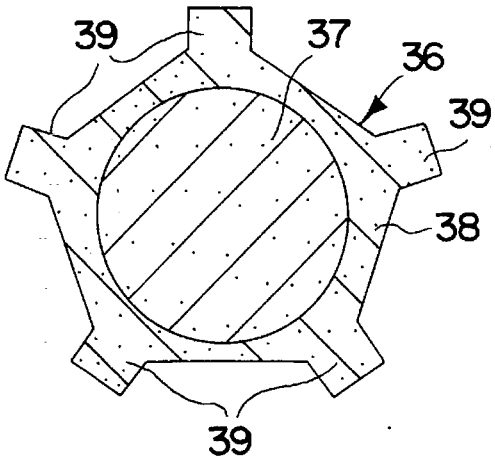
FIG. 2A is a cross-sectional view of an alternative embodiment of a baffle forming part of the torch tip.
Figure 3:
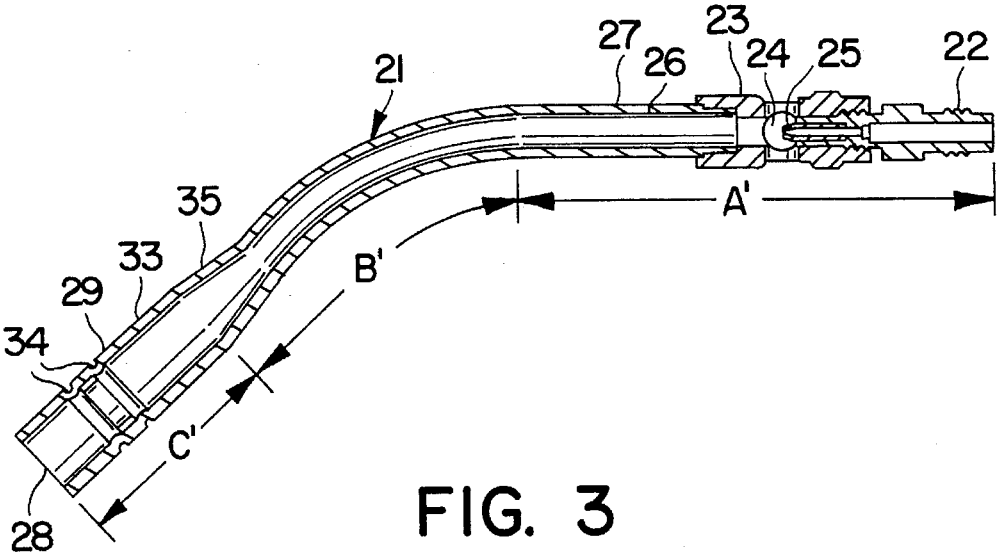
FIG. 3 is a side view of another embodiment of the torch tip of the present invention.

An alternative for the wire screen baffle 9 is baffle 36 illustrated in FIG. 2A. In this embodiment, the baffle comprises a single element of variable density sintered powdered stainless steel. Baffle 36 includes gas permeable inner portion 37 (the term "gas permeable" referring to the property of greatly slowing, or even virtually stalling, a gas flowing against it, and reversing the flow of the majority of such gas; gas passes through, greatly slowed, by winding its way between the particles comprising inner portion 37). Substantially annular gas impermeable portion 38 surrounds inner portion 37. Gas impermeable ribs 39 of baffle 36 serve to connect baffle 36 with the inside wall of the torch tip. Similarly, the baffle could be comprised of a single element of variable density alumina.

Figure 4:
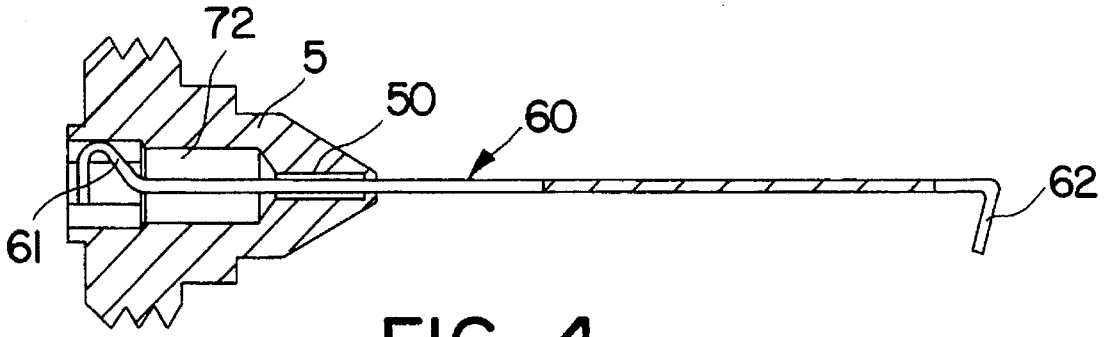
FIG. 4 is cross-sectional view of the orifice tip cleaning mechanism in its installed position in accordance with the present invention.

Turning now to FIG. 4, there is partially shown in cross-section jet nozzle 5 having orifice 50 of relatively small diameter, and orifice 72 of relative large diameter in communication with orifice 50. Positioned in orifice 50 is an elongated wire 60 having a diameter smaller than the diameter of the orifice 50. At or near each end of wire 60 is preferably a bent portion (61, 62) forming a "stop", thereby preventing the wire 60 from being completely removed from the orifice 50. Other means can be used to "lock" or permanently install the wire 60 in the orifice 50, such as by providing the wire with sections of varying diameter; the larger diameter sections (i.e., larger than the orifice 50) providing the stop. It should be understood, however, that regardless of the stop means being used, the wire must be moveable in the orifice to clean the orifice. The surface of wire 60 may be smooth, grooved, knurled or serrated, and is preferably formed of stainless steel.

Figure 5:
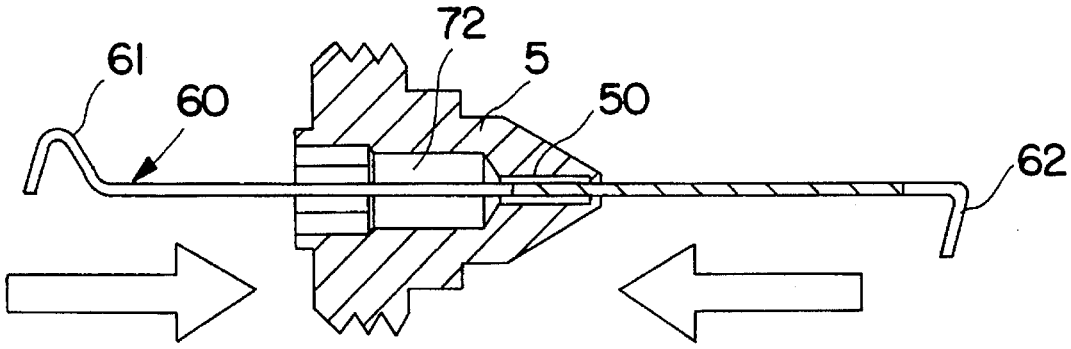
FIG. 5 is cross-sectional view of the orifice tip cleaning mechanism in an operating position in accordance with the present invention.

In operation, dirt in orifice 50 can be dislodged by moving wire 60 in a back-and-forth motion as indicated by the arrows in FIG. 5. Alternatively or in addition, access to wire 60 can be obtained through apertures 4 (FIG. 1), and by merely tapping, striking, jiggling or vibrating the wire 60, dirt can be dislodged. Using this latter method does not require the removal of the nozzle from the torch tip.

One advantage obtained with the cleaning device of the instant invention is that the orifice diameter can be increased in size to accommodate the wire 60, without an effective increase in diameter insofar as gas flow volume is concerned when the wire 60 is in place. Larger diameter orifices are easier to machine (drill).

Figure 6:
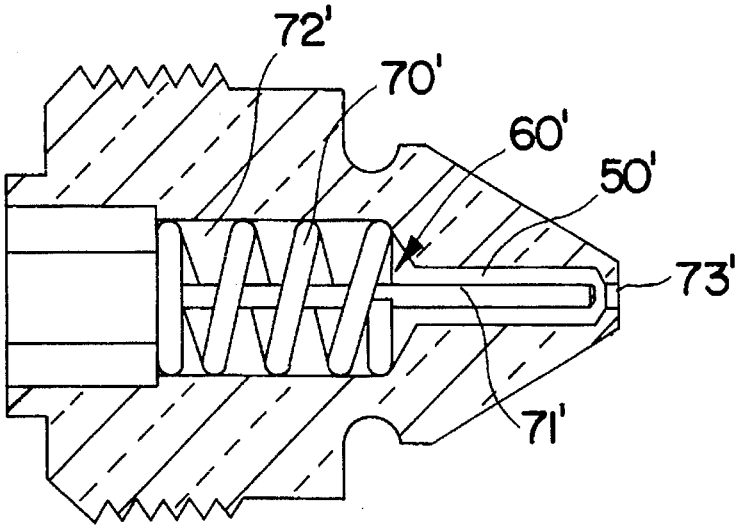
FIG. 6 is a cross-sectional view of the orifice tip cleaning mechanism in its installed position in accordance with an alternative embodiment of the present invention.
Figure 7:
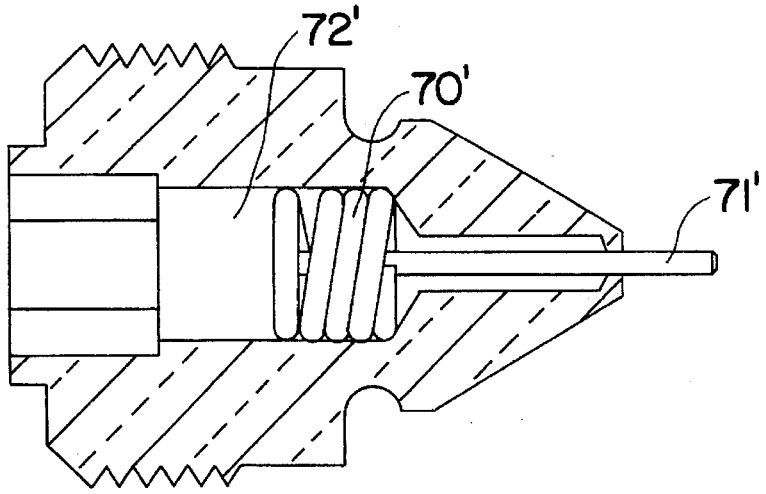
FIG. 7 is a cross-sectional view of the orifice tip cleaning mechanism in an operating position in accordance with an alternative embodiment of the present invention.
Figure 8:
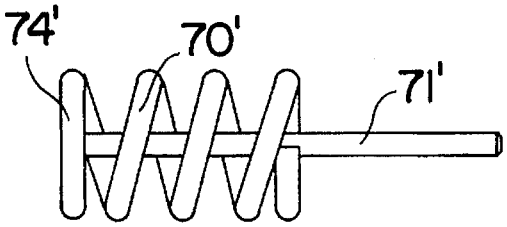
FIG. 8 is a side view of the cleaning mechanism in accordance with an alternative embodiment of the present invention.
Figure 9:
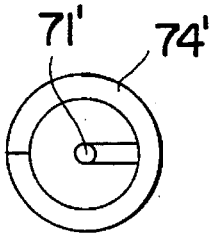
FIG. 9 is a end view of the cleaning mechanism in accordance with an alternative embodiment of the present invention.

FIGS. 6–8 illustrate an alternative embodiment of the present invention which is especially preferred when the diameter of the orifice 50' of jet nozzle 5' is very small. The wire 60' comprises a coiled spring portion 70' integral to or coupled to a longitudinal portion 71' as shown. Preferably the longitudinal portion 71' extends from the rear 74' of the spring as best seen in FIGS. 8 and 9, and is suitably dimensioned so when the mechanism is in its installed but non-operative position as shown in FIG. 6, the distal end of the longitudinal portion 71' does not extend out of the orifice opening 73' and is in such a position as not to affect the flow of gas through the orifice. The coiled spring portion 70' sits in the orifice 72' leading to the orifice 50', and is preferably tapered towards the rear of the spring 74' so that the larger diameter portion of the spring is closest to the orifice 50'. This helps lock the mechanism in place, and as force is applied to the back of the spring 74' furthest from the orifice opening 73', the spring is pushed forward toward the orifice opening 73', increasing the diameter of the spring and locking it to the side wall of the orifice 72'. The force transmits to the longitudinal portion 71', forcing it through the orifice opening 73' as shown in FIG. 7, thereby dislodging any dirt therein.

The particular dimensions of the cleaning mechanism of FIG. 8 depend mostly on the dimensions of the torch tip in which it is used, and in particular, the diameter and length of the orifice 50' and orifice 72'. The diameter of the longitudinal portion 71' must be smaller than the diameter of the orifice 50'. The dimensions of one suitable design are such that the overall diameter of the spring at its narrowest portion is 0.120 inches and 0.130 inches at its widest portion, with a length of 0.200 inches. The overall length of the device in this embodiment, including the longitudinal portion, is 0.375 inches.

One advantage of the this alternative embodiment is the ability of the torch tip to function even where the cleaning mechanism is lost. Since the orifice opening 73' was not enlarged to accommodate the cleaning mechanism, the gas flow therethrough will not be altered, and the injector will still function properly even if the cleaning mechanism is not present.

What is claimed is:

1. A combustion device comprising:

combustible gas receiving means, including a jet nozzle having an orifice for flow of said combustible gas, said orifice terminating in an orifice opening;

combustion supporting gas receiving means;

means for combining said combustible gas and said combustion supporting gas; and cleaning means comprising a coiled spring portion and a longitudinal portion, said coiled spring portion being permanently movably mounted in said orifice from a first, non-cleaning position in which said longitudinal portion is not in said orifice opening to a second, cleaning position in which said longitudinal portion is in said orifice opening for dislodging any dirt therein.

2. The combustion device of claim 1, wherein said coiled portion is tapered.

3. In a combustion device having an elongated tube having a flame emitting section and a gas receiving section coupled to said flame emitting section, and a nozzle in said gas receiving section for ejecting said gas, said nozzle having an orifice terminating in an orifice opening, cleaning means comprising a coiled spring portion and a longitudinal portion, said coiled spring portion being permanently movably mounted in said orifice from a first, non-cleaning position in which said longitudinal portion is not in said orifice opening to a second, cleaning position in which said longitudinal portion is in said orifice opening for dislodging any dirt therein.

4. The combustion device of claim 3, wherein said coiled portion is tapered.

5. A torch tip comprising:

a cylindrical forward section terminating in a front end;

a rearward section for receiving combustible gas and air including fuel jet means having an axial orifice terminating in an orifice opening and having an air induction system, the forward end of said rearward section having an axial cylindrical passageway for receiving the air and combustible gas mixture, said passageway having a diameter smaller than the internal diameter of said forward section;

a middle section, including a generally frustoconical portion, communicatively connecting said forward section to said cylindrical passageway, and adapted to provide a Venturi effect; and cleaning means comprising a coiled spring portion and a longitudinal portion, said coiled spring portion being permanently movably mounted in said axial orifice from a first, non-cleaning position in which said longitudinal portion is not in said orifice opening to a second, cleaning position in which said longitudinal portion is in said orifice opening for dislodging any dirt therein.

6. The torch tip of claim 5, wherein said coiled portion is tapered.

* * * * *